US006216904B1

(12) United States Patent
Cagan

(10) Patent No.: US 6,216,904 B1
(45) Date of Patent: Apr. 17, 2001

(54) DRINK CAN LID WITH CLOSURE CAP

(75) Inventor: Michael N. Cagan, c/ Transimeno 1, E-07600 El Arenal, Baleares (ES)

(73) Assignees: Michael N. Cagan, Baleares; Frank Klose, Mallorca, both of (ES); Andreas Scharf, Regensburg; Peter Wackenbauer, Alling, both of (DE)

( * ) Notice: Subject to any disclaimer, the term of this patent is extended or adjusted under 35 U.S.C. 154(b) by 0 days.

(21) Appl. No.: 09/367,426

(22) PCT Filed: Feb. 13, 1998

(86) PCT No.: PCT/EP98/00805

§ 371 Date: Oct. 25, 1999

§ 102(e) Date: Oct. 25, 1999

(87) PCT Pub. No.: WO98/35883

PCT Pub. Date: Aug. 20, 1998

(30) Foreign Application Priority Data

Feb. 17, 1997 (DE) ..... 197 06 112

(51) Int. Cl.[7] ..... B65D 51/18

(52) U.S. Cl. ..... 220/253; 220/821; 220/824; 220/906

(58) Field of Search ..... 220/253, 821, 220/824, 906

(56) References Cited

U.S. PATENT DOCUMENTS 2,961,133 11/1960 Ankey .
3,726,432 * 4/1973 Gentile ..... 220/253
3,889,842 * 6/1975 Bennett ..... 220/253
5,205,430 * 4/1993 Valyi ..... 220/278
5,692,633 * 12/1997 Gordon ..... 220/253

FOREIGN PATENT DOCUMENTS 82 30 293 U1 10/1982 (DE) .
2 344 465 10/1977 (FR) .
607139 8/1948 (GB) .

* cited by examiner

*Primary Examiner*—Stephen K. Cronin
(74) *Attorney, Agent, or Firm*—Reed Smith LLP

(57) ABSTRACT

The drink can has an off-center opening in its lid, which is firmly connected to the body surface, and is fastened to the body surface by a flanged rim. A closure cap is arranged in a rotatable but non-removable fashion, on this flanged rim. The closure cap has two annular beads that are directed towards the lid, and of which the second annular bead surrounds an opening which has the same eccentricity as the opening in the lid. The first annular bead surrounds a closed region that comprises a sealing ring and a deformable bulge. In the closed state of the drink can, the sealing ring rests on the apex of an annular bead that surrounds the opening. The annular bead is therefore also arranged to be off-center, so that it surrounds the annular bead when the closure cap is in the appropriate rotational position. After the convex bulge has been pressed into a permanent concave position, the closure cap can be rotated, so that the opening in the closure cap aligns with the opening in the lid.

22 Claims, 7 Drawing Sheets

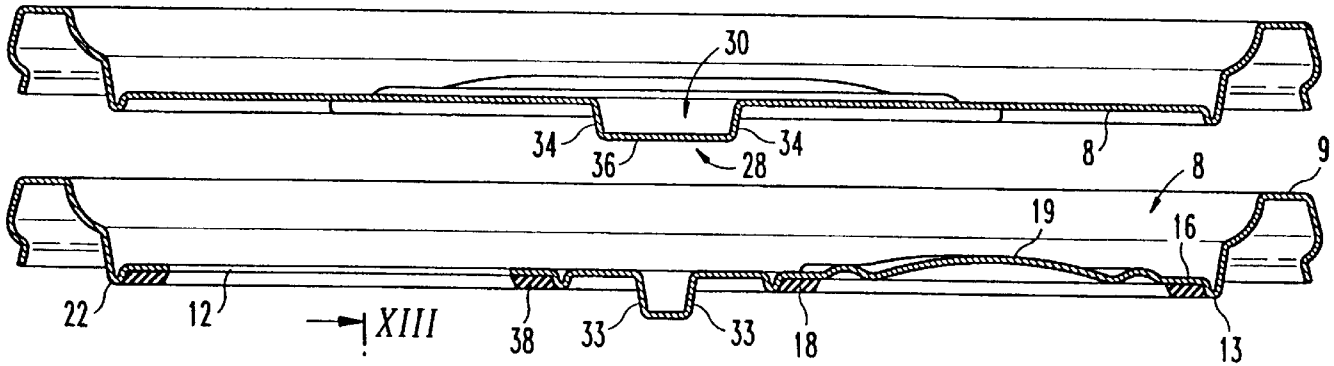
Fig.13
Fig.14
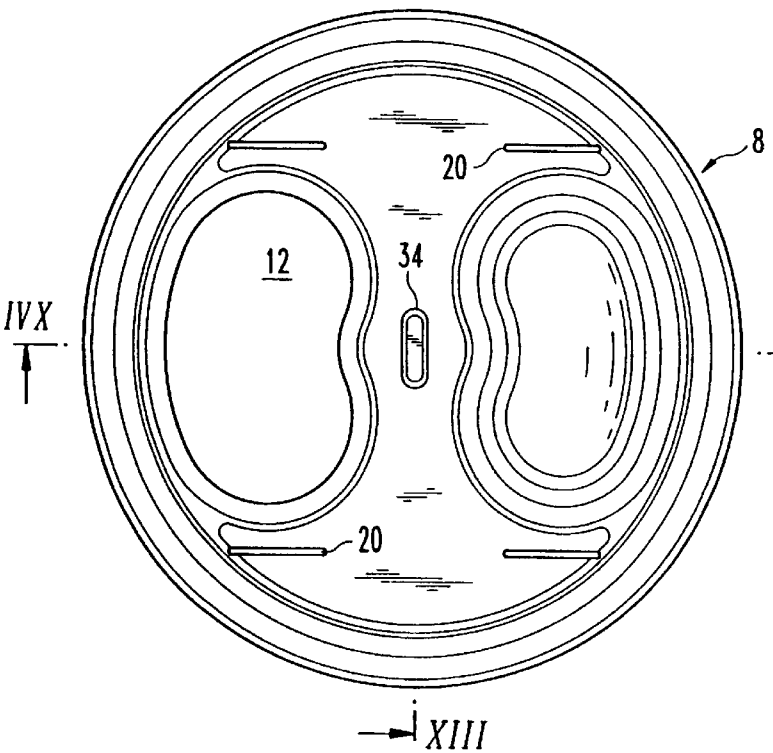
Fig.12

DRINK CAN LID WITH CLOSURE CAP

BACKGROUND OF THE INVENTION a) Field of the Invention

The invention relates to a drink can comprising a lid that is fastened to the cylindrical can body by means of a flanged rim, an off-center opening and a closure cap that covers over the entire lid and is mounted on the flanged rim in a rotatable but non-removable fashion, by means of a marginal bead.

b) Description of the Related Art

Drink cans of this type, which are provided for beer and the widest possible range of non-alcoholic refreshments, have in the lid a pre-stamped, tear-open region and a tear-open tab that is riveted to this region and with which the pre-stamped region can be separated out. The fact that a can, once opened, cannot be closed again is disadvantageous in the case of such drink cans.

A drink can of the type explained at the beginning, but having a pre-stamped, tear-open region in the lid, and a tear-open tab riveted to this region, is known from DE 82 30 293.6 U1. In the case of this known drink can, which corresponds to the previously usual drink cans, after the tear-out opening has been opened, a closure cap having a marginal bead is clipped onto the flanged rim, this closure cap having an opening that can be brought into a position aligning with the removal opening. This configuration makes it possible, after the closure cap has been clipped on, either to protect the still unopened can better against accidental opening, or to close the already opened can.

This clipped-on closure cap, which does not have any additional sealing surfaces around the removal opening, is not able to dose an already opened can so that nothing can run out, since the content of the drink can may get between the can lid and the clipped-on closure cap and there can emerge from the opening in the closure cap, even when the latter is offset with respect to the removal opening in the lid by rotating the closure cap. This closure cap is able only to offer protection against penetrating insects or against running out immediately in the event of the can being turned over briefly, but a leaktight closure for transport, during which the cans are under certain circumstances turned upside down, is not possible. In addition, at the time of the disposal of the empty can, attention must be paid to the fact that the closure cap, which consists of soft plastic must be disposed of separately. The separate manufacture of a closure cap consisting of soft plastic, which is subsequently applied by the consumer, is cumbersome to handle, since it has to be carried along in addition to the can. If such a closure cap is already applied by the manufacturer, then it has to be removed first before the opening of the can and then clipped on again, which is cumbersome. In addition, the manufacture of a closure cap consisting of soft plastic is expensive in relation to the drink cans which are efficiently produced in large-scale mass production and consist of aluminium sheet.

GB 607 139 discloses a closure for containers in which, between the lid of the container and the rotatably mounted closure cap, a soft elastic inlay is provided, which likewise has an opening aligning with the opening in the closure cap and, in this position, is retained by an inwardly drawn rim of the closure cap. Such a closure is well suited for a granular or powdery content and, even in the case of liquid contents, largely prevents them running out, but is not suitable to be applied to the can in the original state for drink cans which are under pressure, such as is the case in beer or cola cans, since this seal would not withstand the pressure. Such a closure can also be applied subsequently to drink cans, which once more is associated with the disadvantages described further above.

FR 23 44 465 discloses a container for powdery or granular contents, for example for herbs or spices, in which a container lid consisting of plastic and having a cylindrical attachment can be pressed into a cylindrical container and can be fixed there, the container lid having a rim that is turned up and has a groove in which a closure lid, which rests on the container lid, is rotatably held. The container lid has an off-center opening which is surrounded by a sealing lip, the latter projecting slightly beyond the upper surface of the container lid and thus being pressed against the inner surface of the closure lid. Although this closure is suitable for powdery media, it is not suitable for liquid media under pressure, since the connection between container lid and container body is not designed for a pressure-tight connection. In addition, such a closure lid could not be applied subsequently in the case of the usual tear-open drink cans, since the latter have a lid which is permanently connected to the can body by a flanged connection.

OBJECT AND SUMMARY OF THE INVENTION

The object of the invention is to provide a drink can which, with low manufacturing costs, provides significant advantages in use with respect to opening and re-dosing, this can being absolutely secure against the contents running out, in particular in the re-closed state, not needing any subsequent closure cap that can be applied and also managing without a tear-open tab for the opening of the can.

In order to achieve this object, on the basis of a drink can corresponding to the type explained at the beginning, two possibilities are provided.

The first possibility is that the opening in the lid is surrounded by an annular bead having essentially conical bead flanks, that the closure cap has an off-center opening that can be brought into alignment with the opening in the lid, that the closure cap has at least one off-center annular bead that is directed towards the lid and has essentially conical bead flanks, surrounds a sealing ring and projects with respect to the latter in the direction of the lid, that, given an appropriate rotational position of the closure cap, the sealing ring rests in a leaktight manner and under pretension on the apex of the annular bead that surrounds the opening in the lid, that, in the event of only one annular bead being constructed, this surrounds the sealing ring and a closed region placed within the sealing ring, and, in the closed position of the closure cap (8), the sealing ring (16) rests in a leaktight manner and under pretension on the apex of the annular bead (5) that surrounds the opening (4) in the lid (1), that in the central region of the closure cap there is constructed a latching cam that engages in a latching hollow in the lid, and that, when the closure cap is rotated, the latching cam cooperates with the latching hollow and, in so doing, moves the inner region of the closure cap that is surrounded by the fixed marginal bead into a position in which the said region is resiliently bowed outwards and in which the sealing ring comes free from the annular bead that surrounds the opening.

In the case of this solution, at the beginning of the rotation of the closure cap, because of the arrangement of the latching cam, which engages in the latching hollow and is controlled upwards on the latter, the closure cap is bowed outwards, as a result of which the region that closes the opening in the lid, in particular the sealing ring, is lifted off the annular bead that surrounds the opening in the lid, specifically to such a great extent that the annular bead that surrounds the opening in the lid and the annular bead that surrounds the closed region and the sealing ring in the closure cap do not abut one another, that is to say do not rub on one another with their bead flanks. This is particularly important when both the lid and the closure cap consist of metal. A mutual rubbing movement without lifting the closure cap could cause a metallic taste in the drink. The annular bead around the opening in the lid and the annular bead around the sealing surface of the closure cap are used to reinforce these regions, in order that the annular bead of the lid can be pressed with great force against the sealing ring, on account of the internal pressure in the drink can, without any bulging of the closure cap, and hence leaks between the annular bead and the sealing ring, being able to occur. This fundamental configuration of the invention, without a particular construction of the closed region, is to be recommended only for those drink cans in which any type of sealing of the closed position is not involved.

If, on the other hand, safeguarding of the closed position is desired to the extent that the first-time opening can be detected later, then a further refinement of the invention is recommended, in which the annular bead of the closure cap, which in the closed position surrounds the annular bead that surrounds the opening in the lid, surrounds a closed region that is formed by the sealing ring and a deformable bulge that is located within the sealing ring, that, in order to open the drink can for the first time, the bulge can be pressed in from its convex position into a permanent concave position, it being the case that, during the transition from the convex into the concave position, the sealing ring comes briefly free from the apex of the annular bead that surrounds the opening in the lid, in order then to rest again with pretension on the apex of the annular bead in the concave position of the bulge.

The permanent concave position of the bulge makes it possible to detect that the drink can has already been opened once. The brief mutual removal of the two bead apexes from each other, and the associated brief removal of the sealing ring from the annular bead that surrounds the opening, not only leads to an escape of the gas pressure prevailing in the can but also forms the precondition for bonding the sealing ring to the annular bead, in order to safeguard the closed position better. As a result of pressing in the bulge, this bonded connection, is destroyed, which in the case of a configuration of a drink can without such a bulge would lead to considerable difficulties when opening the drink can only by rotating the closure cap. The bonded connection would present a considerable resistance to the rotational movement.

An advantageous development of the invention comprises the latching cam and the latching hollow being formed by impressions, which are directed towards the interior of the drink can and deviate from a circular shape, in both the lid and the closure cap, and these impressions engage in one another in the closed position of the closure cap.

If, in a development of the invention, the latching hollow in the lid is surrounded by a rim that projects outwards beyond the lid surface, then when the closure cap is rotated, the latter is lifted to a particularly great extent off the lid, as a result of which the mutual rubbing of the two annular beads is reliably avoided.

According to the invention, a second possibility for achieving the object set at the beginning, based on a drink can of the type explained at the beginning, is that the opening in the lid is surrounded by an annular bead having essentially conical bead flanks, that the closure cap has an off-center opening that can be brought into alignment with the opening in the lid, that the closure cap has at least one off-center annular bead that is directed towards the lid and has essentially conical bead flanks, that, within the annular bead, in each case starting from the inner bead flank, a flat sealing ring adjoins and, given an appropriate rotational position of the closure cap, rests in a leaktight manner and under pretension on the apex of the annular bead that surrounds the opening in the lid, that, in the event of only one annular bead being constructed, this surrounds a closed region that is formed by the sealing ring and a deformable bulge that is located within the sealing ring, that, in the closed position, the annular bead in the closure cap surrounds the annular bead in the lid that surrounds the opening in the lid, and the sealing ring rests in a leaktight manner and under pretension on the apex of the annular bead that surrounds the opening in the lid, that, in order to open the drink can for the first time, the bulge can be pressed in from its convex position into a permanent concave position, it being the case that, during the transition from the convex into the concave position, the sealing ring comes briefly free from the apex of the annular bead that surrounds the opening in the lid, in order then to rest again with pretension on the bead apex in the concave position, that the annular bead in the closure cap projects in the direction of the lid, beyond the sealing ring, and that the region of the closure cap in which an annular bead is constructed can be deflected resiliently with respect to the fixed marginal bead of the closure cap.

By means of this configuration, it is possible to open the drink can by pressing in the deformable bulge, the snap-in movement triggered by the pressing in causing the sealing ring to come briefly free from the annular bead of the lid, as a result of which the positive pressure in the drink can escapes and the closure cap can be rotated into a position in which the opening in the closure cap aligns with the opening in the lid. After the removal of the desired quantity of drink, the drink can may then be closed by rotating the closure cap, the rotation being carried out until the annular bead with the deformable bulge has been pushed over the annular bead that surrounds the opening in the lid and surrounds this annular bead, that is to say until the closure cap again assumes its rotational position or closed position that is provided in the originally closed state. The sealing ring then rests with its sealing surface under pretension on the annular bead of the lid, as a result of which the opening in the lid is again closed. Since the sealing surface is constructed on the sealing ring of the closure cap, it is lifted off the annular bead of the lid during the rotation of the closure cap, as a result of the annular beads being pushed over each other, by which means the destruction of this sealing surface on account of possible frictional forces is avoided, and the sealing surface retains its serviceability even after the drink can has been opened many times. This is particularly important when the sealing rings are provided with sealing elements, these sealing elements preferably consisting of elastomeric material.

Although the desired function is also achievable using only one annular bead in the closure cap, this bead surrounding the sealing ring and the closed region, it is advantageous if, in a further refinement of the invention, in the event of two annular beads being constructed and having sealing rings located on the inside in each case, the second annular bead, with sealing ring, surrounds the opening in the closure cap. This configuration has the advantage that the opening rim in the lid is surrounded by the sealing ring when the can is opened, and this sealing ring, on account of the annular bead that surrounds it, can be pressed against the lid with a relatively large pretension, so that when the liquid is being poured out of the drink can, the said liquid cannot get between the lid and the closure cap.

It is advantageous if, in a further refinement of the invention, there is constructed in the lid a second annular bead which corresponds to the size and shaping of that annular bead that surrounds the opening in the lid. By this means, in the closed position the annular bead that surrounds the opening in the closure cap can rest, with its sealing-ring surface adjacent on the inside, on this second annular bead in the lid, as a result of which any liquid that has penetrated between lid and closure cap remains enclosed and cannot emerge from the opening in the closure cap. In addition, it is ensured that, in the closed position, the closure cap is supported uniformly with respect to the lid, so that any deformation of the closure cap, which would lead to the sealing-ring surface lifting off the annular bead that surrounds the opening in the lid, is avoided. Of course, in this case the second annular bead is arranged in such a way that, given an appropriate rotational position of the closure cap, it can cooperate with each of the two annular beads of the closure cap and comes into alignment with the annular bead that surrounds the opening in the closure cap when the other annular bead of the closure cap aligns with the annular bead that surrounds the opening in the lid.

If, in a further refinement of the invention, the closure cap is constructed like a plate with a marginal bead that widens conically outwards, the outer free flank of the marginal bead being used for fastening to the flanged rim of the drink can, then by this means, even when using a thin-walled closure cap, adequate pretension is achieved, which is necessary in order to press the sealing ring that is located within the corresponding annular bead against the annular bead of the lid.

This pretension can be further supported in that, in an advantageous further refinement of the invention, the bottom of the closure cap is bent slightly in the direction of the lid of the drink can.

In order to provide the necessary freedom of movement of these annular beads when pressing in the deformable bulge and during the mutual rotation of the interengaging annular beads, provision is made, in a development of the invention, for each resiliently constructed region which accommodates an annular bead to be partly bounded by slits in the closure cap, these slits extending at a distance from the respective annular bead, starting from the inner conical flank of the annular bead of the closure cap and extending over part of the closure cap dimension.

It is sufficient if each annular bead is assigned two slits, which are located in mirror-image fashion on opposite sides of the respective annular bead.

The construction of slits is particularly advantageous in the case of closure caps which consist of metal, for example stainless steel or aluminum. On the other hand, in the case of closure caps which are manufactured from plastic, it is also possible to manage with deep grooves instead of the slits.

A favorable resilient action of the regions accommodating the annular beads results if the slits or grooves extend essentially parallel to a tangent to an annular bead.

If, in a development of the invention, in the appropriate rotational position of the closure cap, in which the respective annular bead of the closure cap surrounds the annular bead of the lid, the inner flanks of the annular beads that are constructed in the closure cap rest closely on the outer flank of the annular bead assigned to the lid, then the pressing action of the sealing ring on the annular bead of the lid is increased, in particular in the case of thin-walled closure caps. In addition, by this means the respective rotational position in the opened or closed state is precisely fixed, whereas such a fixed position is not provided exactly if the respective annular bead of the closure cap surrounds the annular bead of the lid with a space.

A particularly advantageous refinement is provided by both the openings in the lid and the closure cap and all the annular beads having a circumference that deviates from a circular shape, and preferably having a kidney-like form. By this means, when the bulge is pressed in, a sharper snap effect and hence reliable lifting of the sealing ring of the closure cap off the annular bead that surrounds the opening in the lid may be brought about. In addition, this results in a broad opening, whose region associated with the marginal bead extends parallel to this marginal bead over a great length, so that drinking from the can is facilitated.

An advantageous configuration is characterized in that all the annular beads have a circular circumference.

Although the annular beads may assume any desired angular position in relation to one another, it is certainly to be recommended, on visual grounds, that the annular beads of the closure cap and those of the lid lie diametrically opposite one another. By this means, an equally large resilient region can also be assigned to each annular bead.

In order to improve the sealing action of the sealing rings, the sealing rings may be provided with sealing elements. Rubber rings or resilient plastic rings are suitable for this, and these can be bonded to the closure cap.

Easy handling when opening the drink can is ensured by the fact that, in a development of the invention, the bulge within the first bead ring of the closure cap is constructed as a spherically domed area Favorable sealing possibilities between lid and closure cap in the opened state result if, in a development of the invention, the opening in the lid and the opening in the closure cap are essentially coincident.

Manufacture is simplified, in an advantageous way, if, in a development of the invention, the closure cap and the lid consist of the same material, preferably of metal.

OBJECT AND SUMMARY OF THE INVENTION

The invention is explained in more detail below using exemplary embodiments illustrated in the drawing, in which:

FIG. 12 shows a view of a closure cap of a drink can according to the third embodiment;

FIG. 13 shows a section along the line XII—XIII in FIG. 12;

FIG. 14 shows a section along the line XIV—XIV in FIG. 12;

DESCRIPTION OF THE PREFERRED EMBODIMENTS

Figure 2:
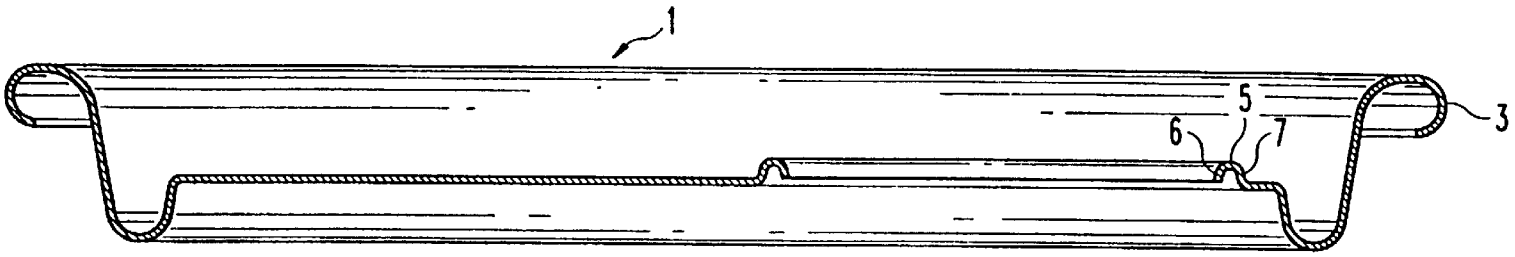
FIG. 2 shows a cross section through this lid.
Figure 1:
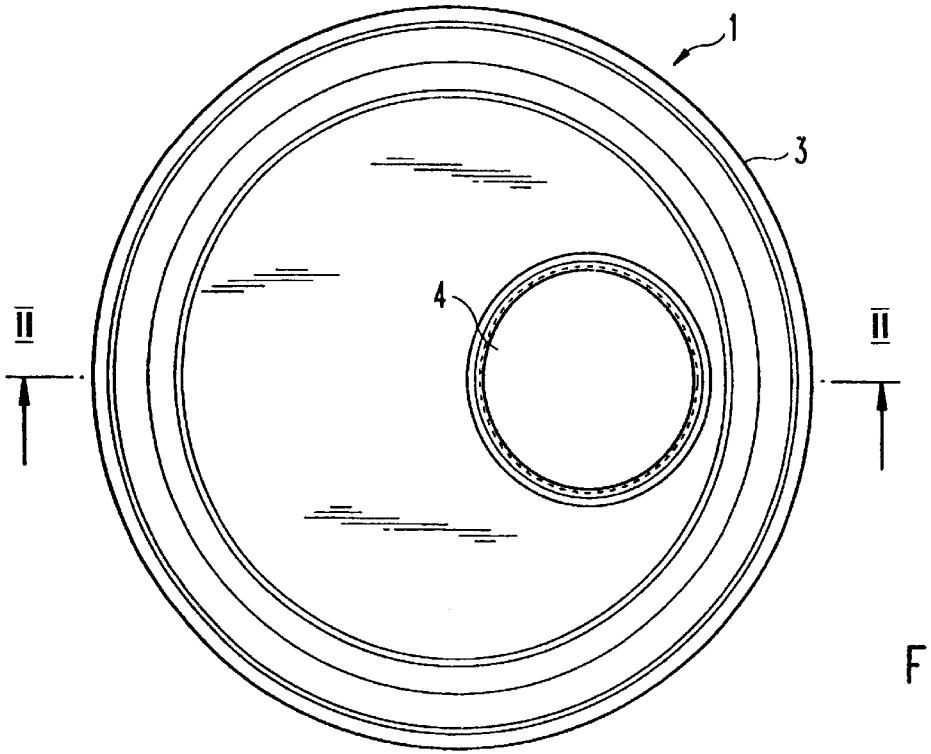
FIG. 1 shows a view from above of a lid of an inventive drink can.
Figure 4:
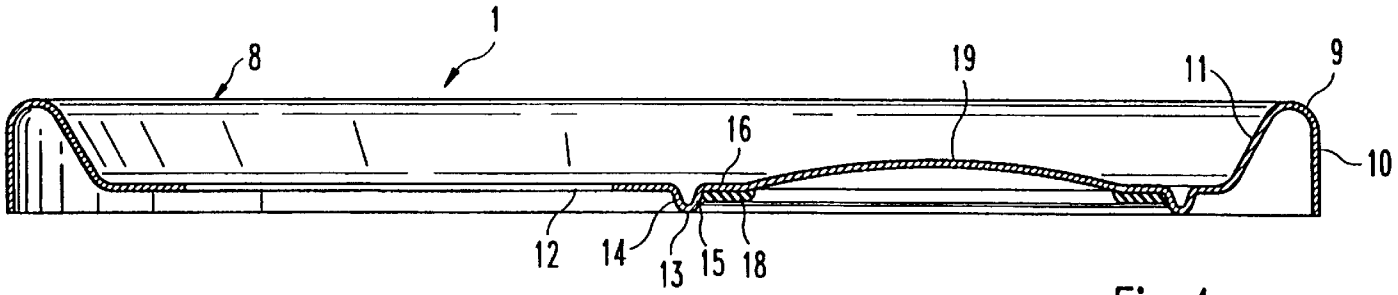
FIG. 4 shows a cross section through this closure cap.

As can be seen from the drawing, in particular in conjunction with FIGS. 1 to 5, a lid 1 of a drink can, this lid being fixed to a body 2 of this drink can by means of a flanged rim 3, has an off-center opening 4, which is surrounded by an annular bead 5 which has essentially conical flanks 6 and 7. Arranged over the lid 1 is a closure cap 8 which closes the lid completely, as can be seen in conjunction with FIGS. 6 to 8, which show a second embodiment. The closure cap 8 is constructed like a plate and has a marginal bead 9 that widens conically outwards and whose outer free flank 10 is flanged around the flanged rim 3 of the lid in such a way that the closure cap 8 can be rotated with respect to the lid 1 but cannot be lifted. The inner conical flank 11 of the marginal bead 9 contributes significantly to stiffening the closure cap 8.

The closure cap 8 is provided with an off-center opening 12 which, given an appropriate rotational position of the closure cap, can be brought into alignment with the opening 4 in the lid 1 of the drink can, that is to say has the same eccentricity. Furthermore, the closure cap 8 has an annular bead 13 (FIG. 4) which, in the assembled state, is directed towards the lid, and has essentially conical flanks 14 and 15. This annular bead 13 surrounds a sealing ring 16, which is constructed inside the annular bead 13 as a flat ring and is located within the plane of the bottom 17 of the closure cap. At its side that faces the lid 1 in the assembled state, the sealing ring 16 is provided with an elastic sealing element 18, which, for example, is fastened by bonding to the underside of the sealing ring 16. On its inner margin, the sealing ring 16 is connected in one piece to a bulge 19, which is constructed so as to be deformable and, in the closed position of the drink can, has the shape of a convex spherically domed area.

Figure 6:
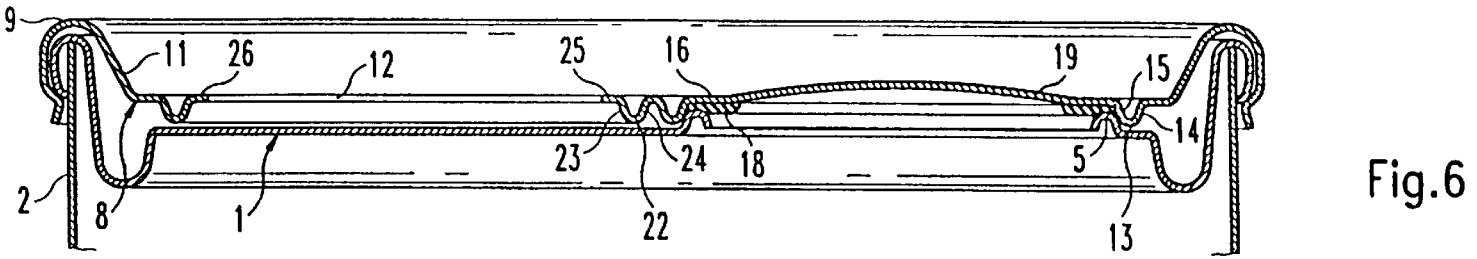
FIG. 6 shows a section through the upper part of an inventive drink can having a second embodiment of the closure cap, in the original closed and sealed state of the drink can.

In the closed and sealed state of the drink can, which emerges from FIG. 6, there being no differences between the embodiments with regard to the closed state, the annular bead 13 surrounds the annular bead 5, resting closely with its inner flank 15 on the outer flank 7 of the annular bead 5. The sealing element 18 rests in a leaktight manner and under pretension on the apex of the annular bead 5. This pretension is essentially brought about by the conical shape of the inner flank 11 of the marginal bead 9. In addition to this, the bottom 17 of the closure cap can be bent slightly in the direction of the lid 1, in order to reinforce this pretension further. Furthermore, the internal pressure in the drink can presses the sealing element 18 and annular bead 5 against each other.

In order to open the drink can, the bulge 19 is transferred from its convex position into a permanent concave position by pressing in, which during the passage of this bulge 19 through the flat middle position leads to an intermediate lifting of the sealing ring 16 and hence to a lifting of the sealing element 18 off the apex of the annular bead 5 which surrounds the opening 4 in the lid. By this means, the compressed gas in the drink can may escape, as a result of which the lid 1 of the drink can is no longer pressed upwards with such a great force, so that the contact pressure between the apex of the annular bead 5 and the sealing element 18 of the sealing ring 16 is now only restricted to the pretension brought about by the closure cap 8. During the pressing-down of the bulge 19, at the instant when this bulge passes through the flat middle position, not only is the sealing ring 16 tilted and thus lifted, but this operation also leads to a tilting or twisting of the annular bead 13, which is only possible if the region around the annular bead 13 is constructed to be resiliently compliant. When the bulge 19 assumes its permanent lower concave position, as emerges from FIG. 7, then the annular bead 13 and the sealing ring 16, because of the resilient properties of the region accommodating them, have again assumed a position in which the sealing ring 16 rests with pretension on the annular bead 5 of the lid. In this state, the sealing is cancelled, but the can is still closed.

Figure 3:
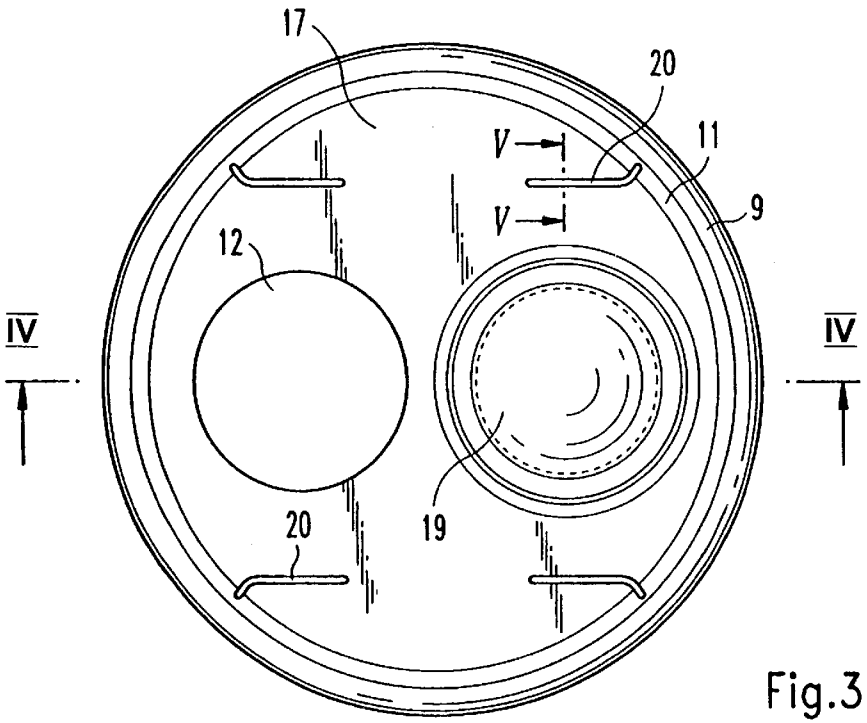
FIG. 3 shows a view of an inventive closure cap for a drink can.

In order to achieve this necessary resilient property, the closure cap, as can be seen from FIG. 3, is provided with slits 20 or grooves 21 which, in the exemplary embodiment illustrated, are arranged in such a way that in each case two parallel slits are assigned to one annular bead. In FIG. 3, although, in contrast with the second embodiment according to FIGS. 6 to 8, the opening 12 is not provided with an annular bead, a certain resilient property is also necessary here, since the rim surrounding the opening 12 rests on the apex of the annular bead 5 in the opened position of the drink can, and must rest there with pretension and in a sealing manner, since otherwise the liquid can get between the lid and the closure cap. The four slits originate from the lower region of the conical flank 11 of the marginal bead 9 and run with a sufficiently large spacing from the opening 12 or the annular bead 5, and extend approximately over one quarter of the chord of the circular bottom 17 of the closure cap.

Figure 5:
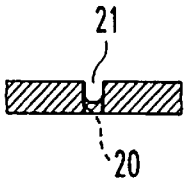
FIG. 5 shows a section along the line V—V in FIG. 3.

FIG. 5 shows a groove 21, using a continuous line, and slots 20, using a dashed line. Such grooves are possible, in order to achieve the resilient property of the region that surrounds the annular bead or the opening, if the closure cap consists of plastic, so that the region which is weakened by the groove 21 can inherently give way. If, on the other hand, the closure caps are produced from metal, then it is expedient to provide slits 20. This type of slit arrangement is also provided in the case of the second embodiment according to FIGS. 6 to 8, although this cannot be taken from the figures because of the sectional illustration.

Figure 7:
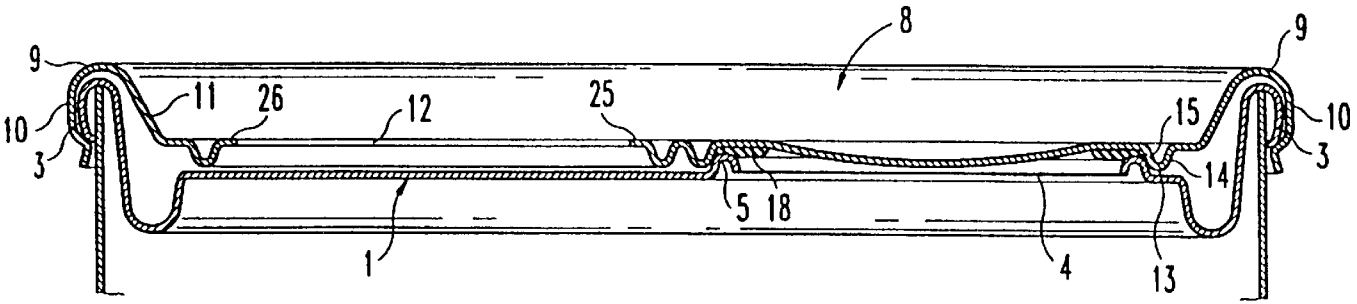
FIG. 7 shows a section, corresponding to FIG. 6, through the upper part of a drink can in the opened state of the seal but closed state of the opening of the lid of the drink can.
Figure 8:
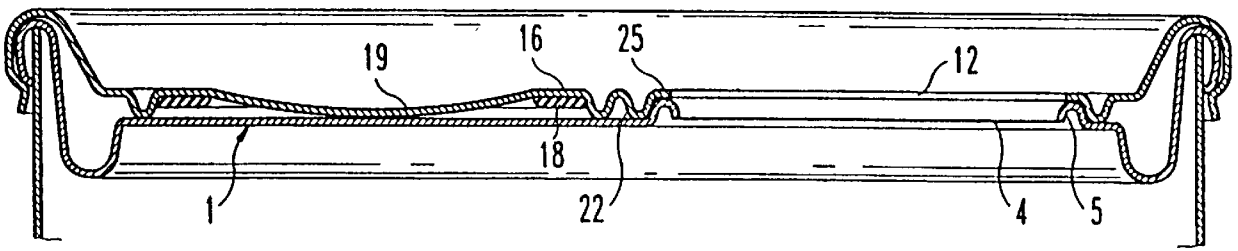
FIG. 8 shows a section, corresponding to FIG. 6, in the opened state of the drink can.
Figure 10:
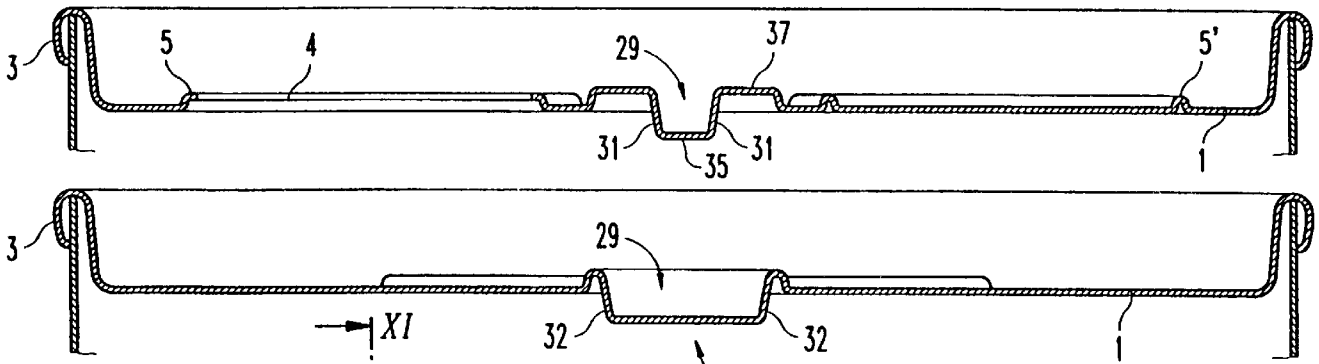
FIG. 10 shows a section along the line X—X in FIG. 9.
Figure 11:
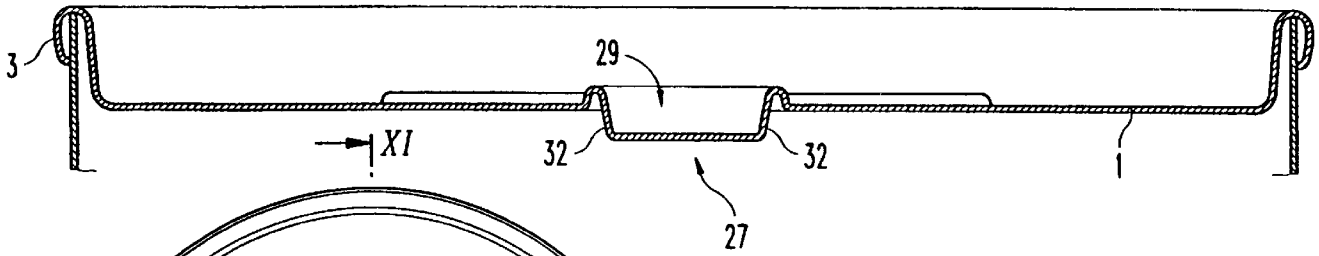
FIG. 11 shows a section along the line XI—XI in FIG. 9.
Figure 9:
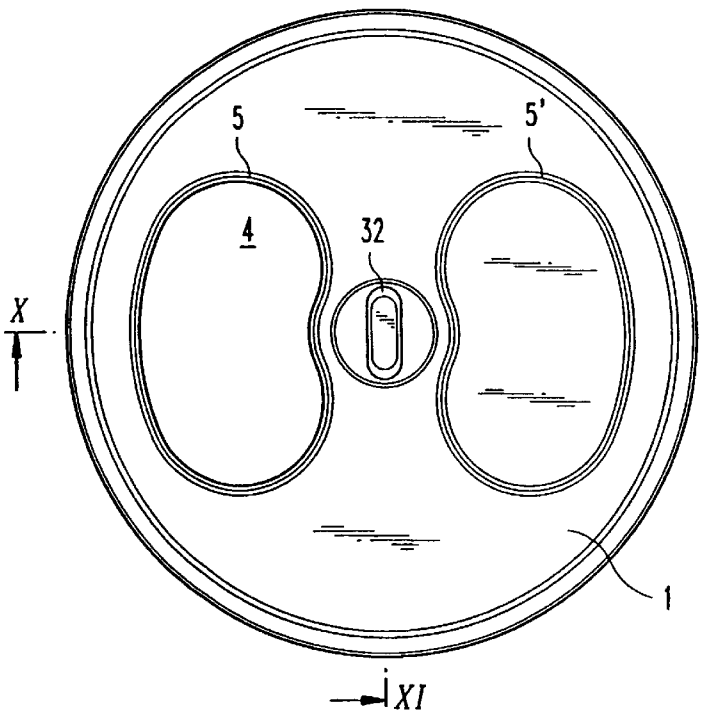
FIG. 9 shows a plan view of the lid side of a drink can of a third exemplary embodiment.
Figure 15:
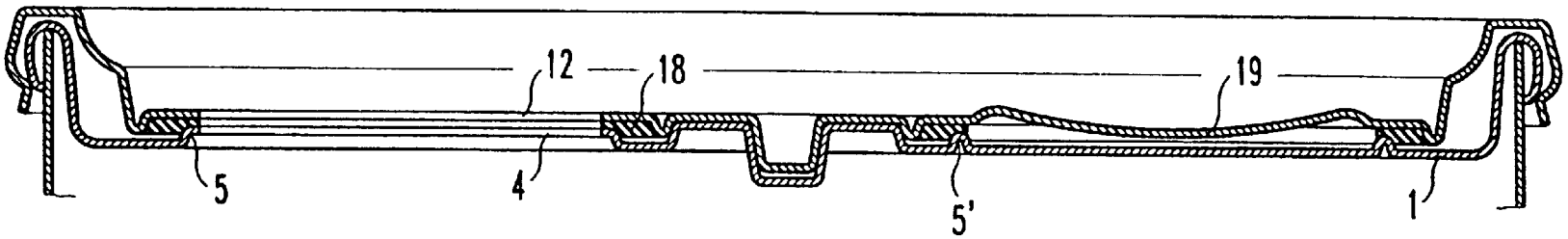
FIG. 15 shows a cross section through the upper part of the drink can according to the third embodiment, in the opened state corresponding to the line XIV—XIV in FIG. 12.
Figure 16:
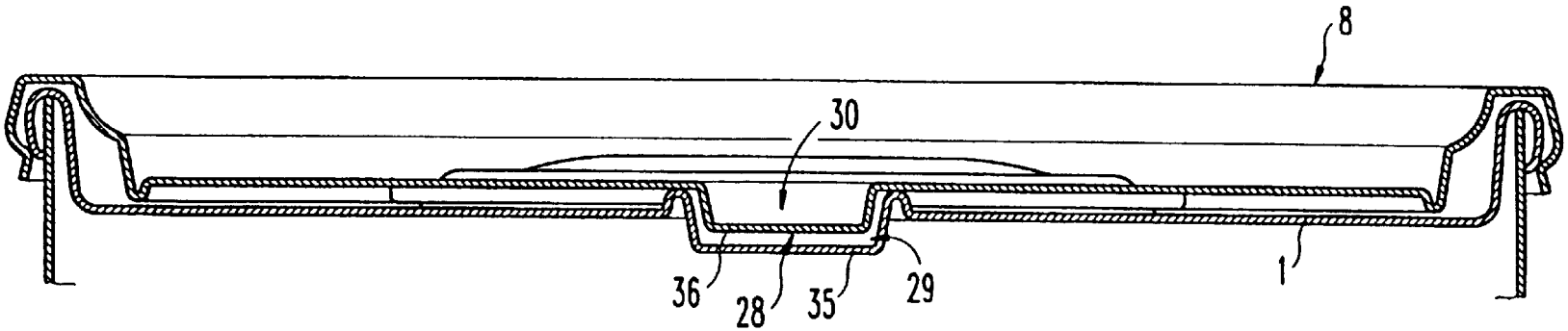
FIG. 16 shows a cross section through the upper part of the drink can a plane lying perpendicular to FIG. 15.
Figure 17:
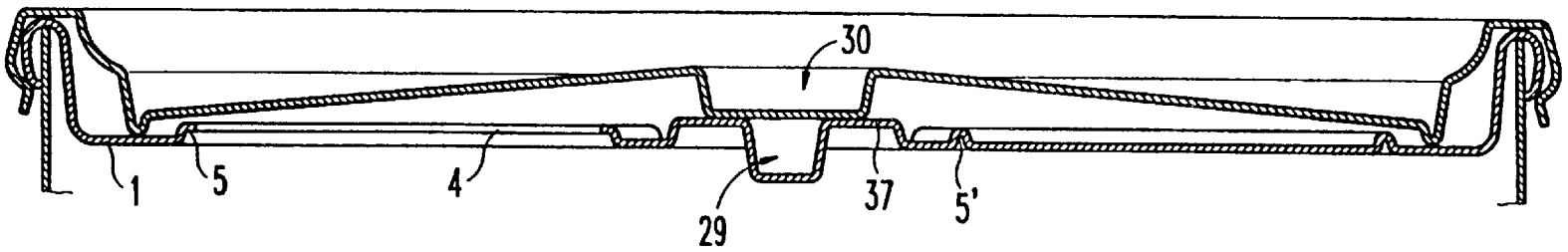
FIG. 17 shows a cross section through the upper part of the drink can during the opening phase.
Figure 18:
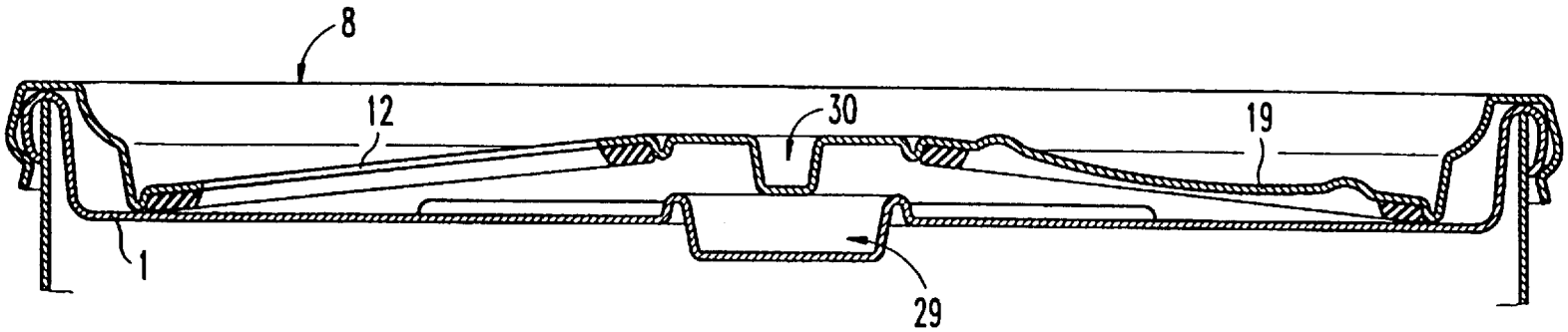
FIG. 18 shows a cross section through the upper part of the drink can in a plane lying perpendicular to FIG. 17.

The second embodiment, which is illustrated in FIGS. 6 to 8, differs from the first embodiment (FIGS. 1 to 5) only in the fact that not only is the region enclosed by the bulge 19 surrounded by an annular bead 13, but the opening 12 is also surrounded by an annular bead 22 having conical bead flanks 23 and 24.

FIG. 6 shows the closed and sealed state of the drink can, that is to say the state in which the can still has not been opened. In this case, the sealing ring 16 rests with its sealing element 18 on the apex of the annular bead 5. The deformable bulge 19 still has its convex shape, and the sealing ring is not only pressed against the annular bead 5 because of the pretension of the bottom 17 of the closure cap 8, but their mutual pressing is also effected by the internal pressure prevailing in the drink can. In order to open the can, as already described in conjunction with the first embodiment, the deformable bulge 19 is pressed, according to FIG. 7, into the permanent concave position, as a result of which, during the transition from the convex form into the concave form, the sealing ring 16 is briefly lifted from the apex of the annular bead 5. During this process, gas escapes from the drink can, as a result of which the sealing ring 16 is no longer pressed so hard against the annular bead 5. In this state, which is illustrated in FIG. 7, the closure cap 8 can now be rotated, it being the case that the regions of the bottom 17 which are constructed to be resilient by means of slits 20 and surround the annular bead 13, are lifted as a result of the mutual displacement of the annular beads 5 and 13 that occurs at the same time. In this case, the oblique bead flanks 15 and 7 slide on each other and thus effect the lifting of the resiliently constructed bottom 17 of the closure cap 8. If the two bead rings 13 and 22 are located diametrically opposite each other, the closure cap has to be rotated through 180° degrees in order that the off-center opening 12 comes to lie above the opening 4 in the lid 1 of the drinks can, as can be seen in FIG. 8. In this opened position, the annular bead 22 surrounds the annular bead 5 and rests with its inner flank 23 on the outer flank 7 of the annular bead 5. The annular bead 22 does not quite reach as far as the opening 12, so that a sealing ring 25 corresponding to the sealing ring 16 remains, rests in a leaktight manner on the apex of the annular bead 5 and can be provided with a sealing element 26 that is extremely thin and therefore cannot be seen in the drawing. As a result of the arrangement of the annular bead 22, the sealing ring 25 is stabilized, with the result that it rests in a leaktight manner and with pretension by way of its sealing element 26 on the apex of the bead ring 5, and as a result achieves better sealing than is the case in the first embodiment, in which the opening 12 is not surrounded by an annular bead. From this opened position, the closure cap 8 can be rotated again into the closed position, which can be seen from FIG. 7. In this position, although the bulge 19 has already been permanently pressed downwards, the pretension of the bottom 17 is sufficient to press the sealing ring 16 by way of its sealing element 18 tightly against the apex of the annular bead 5, and hence to close the drink can if only part of the content has been removed following opening.

Since the annular beads 13 and 22 in each case slide over the annular bead 5 in the event of a rotation of the closure cap 8 out of the position according to FIG. 6 into the position according to FIG. 8 and back again into the position according to FIG. 7, as a result of which the bottom 17 of the closure cap 8 is lifted, it is ensured that the sealing element 18 or 26 is lifted off the apex of the annular bead 5, and is thus not subjected to any shear action when the closure cap is rotated, which protects the sealing surface or the corresponding sealing element. It can be seen from the previous description that not only does the opening 12 have the same eccentricity with respect to the major axis of the drink can, as is the case in the opening 4, but the region that is closed by the bulge 19 also has the same eccentricity, with the result that the opening 4 in the lid 1 of the drink can can be closed by this region that is located within the annular bead 13 and, in particular, by the sealing ring 16.

FIGS. 9 to 18 show a third, preferred embodiment of the invention. Insofar as there is agreement with the first embodiment according to FIGS. 1 to 8, the same reference symbols are provided.

The decisive difference with respect to the first embodiment is that a latching hollow 29 is constructed in the central region of the lid 1, and latching cams 28 are constructed in the central region of the closure cap 8. The latching cams and the latching hollow are formed by impressions 27 and 30, respectively, which are of trough-like construction with rounded ends, the latching cams 28 in the closure cap 8 fitting in a positively-locking manner into the latching hollow 29 in the lid 1 when in the closed position. This fitting into one another in the closed position can be seen in FIGS. 15 and 16. The latching hollow 29 in the lid 1 has side walls 31 that taper conically in the direction of the interior of the can, and round front walls 32 which likewise taper conically in the direction of the interior of the can. The latching cams 28 in the closure cap 8 have side walls 33 that taper conically in the direction of the interior of the can, and round front walls 34 that likewise taper conically towards the inside. In the case of both impressions (cams and hollow), the side and front walls merge with an appropriately small transition radius into a respectively flat bottom 35 and 36.

Because of these conically tapering walls, when the closure cap 8 is rotated with respect to the lid 1, the closure cap is lifted, since the mutually touching walls are displaced like two wedge areas resting on one another during this rotational movement, this being brought about by the rounded front ends of the impressions. In principle, the bulge 19 could be dispensed with, since the lifting of the sealing ring 16 from the annular bead 5 that surrounds the opening 4 could be brought about as the result of the lifting of the closure cap 8 on account of the cooperating latching cams 27 and 28, but in the case of the preferred embodiment illustrated, the bulge 19 is maintained for the reason which is explained below. This is because, if the bulge 19 is not present and this is therefore not permanently deformed—as explained in the first two exemplary embodiments—then it is not possible to see from the closure cap whether the drink can has already been opened once. In the originally closed state, therefore, the sealing ring 16 with its sealing element 18 is firmly bonded on the annular bead 5 by means of an adhesive that is not illustrated in the drawing. This bonded connection opposes the rotation of the closure cap with such a large resistance that the closure cap cannot be rotated and the drink can cannot be opened. In order to achieve opening, the bulge 19 is permanently deformed inwards, that is to say is transferred into a permanent concave form. By this means, the marginal region, as already explained in conjunction with the exemplary embodiments according to FIGS. 1 to 8, is lifted briefly, as a result of which the sealing ring 16 and thus the firmly bonded sealing element 18 comes free from the annular bead 5. After this, the closure cap 8 can be rotated, as already explained. The lifting of the closure cap in its region covering the lid 1 is maintained during the entire rotational movement, since the bottom 36 rests on a rim 37 that surrounds the latching hollow 29 and projects, as emerges from FIG. 17. By this means, wear of the sealing element is reliably prevented during the rotational movement, with the result that the drink can may be closed again and opened as often as desired. Since any rubbing movement between the sealing element 18 of the sealing ring 16 and the annular bead 5 is reliably dispensed with during the opening movement, the abrasion of microfine metal particles from the annular bead 5 is avoided, as a result of which any impairments to the taste of the liquid contained in the drink can is avoided.

In the case of the third exemplary embodiment, the opening 4 is no longer circular, as in the case of the first two exemplary embodiments, but is kidney shaped and thus of oval construction in its basic form. Hence, the annular bead 5 that surrounds the opening 4 is necessarily also configured to be kidney-shaped and, likewise, the bulge 19 and the annular bead 13 that surrounds the bulge 19 are also of kidney-shaped construction. This configuration leads to the bulge 19 being easier to deform and to a more pronounced lifting movement of the sealing ring 16 from the annular bead 5 while the bulge 19 is being pressed in. By this means, the sealing of the closed position, which is produced by a bonding, is more easily cancelled. The permanent pressed-in position of the bulge 19 following the first opening now indicates reliably that the can has already been opened once. This contributes to the security for the user, who is now able to assume that, given the outwardly directed shape of the bulge 19, the drink can is in its originally closed state. The result of the kidney-shaped form of the opening 4 is also that a very large marginal region of the opening is located close to the marginal bead 9, which makes drinking from the drink can easier, since conditions have now been provided which are like those when drinking from a glass or cup.

Slits 20 are also provided in the case of the third embodiment, in order to bring about better resilient properties of the closure cap in the region that surrounds the annular bead 13.

Although it is not strictly necessary for the fundamental function, there is constructed in the lid 1 a second annular bead 5', which is located diametrically opposite the annular bead 5, has the same form as the annular bead 5 and is located in mirror-image fashion with respect to the latter. This leads to improved stability of the lid 1.

In addition, in the opened position of the closure cap 8, the sealing ring 16 comes to rest on this second annular bead 5', which avoids any deformation of the closure cap in the opened state, which could lead to the sealing element 38 that surrounds the opening 12 in the closure cap 8 being able to be lifted from the annular bead 5 in the opened position of the closure cap, as a result of which liquid would penetrate between the lid and the closure cap. During the subsequent closing of the drink can, this liquid, located between lid 1 and closure cap 8, could then run out of the opening 12 in the closure cap and contaminate the surroundings. If, nevertheless, liquid should get between the lid 1 and the closure cap 8, then this liquid is prevented from flowing out by a sealing brought about by the sealing element 38 resting on the annular bead 5'.

The annular beads 13 and 22 of the closure cap 8 are identical to each other and constructed in mirror-image fashion with respect to each other, to be specific in the same way as the annular beads 5 and 5' of the lid 1, with the result that, in the closed position, the annular beads 5 and 13 and the annular beads 5' and 22 cooperate, and in the opened position, the annular beads 5 and 22 and the annular beads 5' and 13 cooperate.

while the foregoing description and drawings represent the present invention, it will be obvious to those skilled in the art that various changes may be made therein without departing from the true spirit and scope of the present invention.

What is claimed is:

1. A drink can comprising:

a lid that is fastened to a cylindrical can body by a flanged rim;

said lid having an off-center opening and a closure cap that covers over the entire lid and is mounted on the flanged rim in a rotatable but non-removable fashion, by a fixed marginal bead;

the opening in the lid being surrounded by an annular bead having essentially conical bead flanks;

the closure cap having an off-center opening that can be brought into alignment with the opening in the lid;

the closure cap having at least one off-center annular bead that is directed towards the lid and having essentially conical bead flanks, surrounding a sealing ring and projecting with respect to the latter in the direction of the lid;

given an appropriate rotational position of the closure cap, the sealing ring rests in a leaktight manner and under pretension on the apex of the annular bead that surrounds the opening in the lid;

wherein if in the closure cap only one at least one off-center annular bead is constructed, this one at least one off-center annular bead surrounds the sealing ring and a closed region placed within the sealing ring, and, in the closed position of the closure cap, the sealing ring rests in a leak-tight manner and under pretension on the apex of the annular bead that surrounds the opening in the lid;

in the central region of the closure cap there is constructed a latching cam that engages in a latching hollow in the lid; and when the closure cap is rotated, the latching cam cooperates with the latching hollow and, in so doing, moves an inner region of the closure cap that is surrounded by the fixed marginal bead into a position in which the inner region is resiliently bowed outwards and in which the sealing ring comes free from the annular bead that surrounds the lid opening.

2. The drink can according to claim 1, wherein the at least one off-center annular bead of the closure cap, which in the closed position surrounds the annular bead that surrounds the opening in the lid, surrounds a closed region that is formed by the sealing ring and a deformable bulge that is located within the sealing ring, in that, in order to open the drink can for the first time, the bulge can be pressed in from its convex position into a permanent concave position, it being the case that, during the transition from the convex into the concave position, the sealing ring comes briefly free from the apex of the annular bead that surrounds the opening in the lid, in order to subsequently rest again with pretension on the apex of the annular bead that surrounds the opening in the lid in the concave position of the bulge.

3. The drink can according to claim 1, wherein the latching cam and the latching hollow are formed by impressions, which are directed towards the interior of the drink can and deviate from a circular shape, in both the lid and the closure cap, and these impressions engage in one another in the closed position of the closure cap.

4. The drink can according to one of claim 1, wherein the latching hollow in the lid is surrounded by a rim that projects outwards beyond the lid surface.

5. A drink can comprising:

a lid that is fastened to a cylindrical can body by a flanged rim;

said lid having an off-center opening and a closure cap that covers over the entire lid and is mounted on the flanged rim in a rotatable but non-removable fashion, by a fixed marginal bead;

the opening in the lid being surrounded by an annular bead having essentially conical bead flanks;

the closure cap having an off-center opening that can be brought into alignment with the opening in the lid;

the closure cap having at least one off-center annular bead that is directed towards the lid and having essentially conical bead flanks;

the closure cap including with the at least one off-center annular bead, in each case starting from the inner bead flank, a flat sealing ring adjoining, and, given an appropriate rotational position of the closure cap, resting in a leaktight manner under pretension on an apex of the annular bead that surrounds the opening in the lid;

wherein if in the closure cap only one at least one off-center annular bead is constructed, this at least one off-center annular bead surrounds a closed region that is formed by the sealing ring and a deformable bulge that is located within the sealing ring;

in the closed position, the annular bead in the closure cap surrounding the annular bead in the lid that surrounds the opening in the lid, and the sealing ring resting in a leaktight manner under pretension on the apex of the annular bead that surrounds the opening in the lid;

wherein in order to open the drink can for the first time, the bulge can be pressed in from its convex position into a permanent concave position, it being the case that, during the transition from the convex into the concave position, the sealing ring coming briefly free from the apex of the annular bead that surrounds the opening in the lid, in order then to rest again with pretension on the bead apex in the concave position;

the annular bead in the closure cap projecting in the direction of the lid, beyond the sealing ring; and the region of the closure cap in which an annular bead is constructed can be deflected resiliently with respect to the fixed marginal bead of the closure cap.

6. The drink can according to claims 1 or 5, wherein, in the event that two at least one off-center annular beads are constructed and having sealing rings located on the inside in each case, the second at least one off-center annular bead, with sealing ring, surrounds the off-center opening in the closure cap.

7. The drink can according to claims 1 or 5, wherein there is constructed in the lid a second annular bead which corresponds to the size and shaping of the annular bead that surrounds the opening in the lid.

8. The drink can according to claims 1 or 5, wherein, in the appropriate rotational position of the closure cap, in which the respective at least one off-center annular bead of the closure cap surrounds the annular bead of the lid, the inner flanks of the at least one off-center annular beads that are constructed in the closure cap rest closely on the outer flank of the annular bead of the lid.

9. The drink can according to claims 1 or 5, wherein both the openings in the lid and the closure cap and all the annular beads have a circumference that deviates from a circular shape, and have a kidney-like form.

10. The drink can according to claims 1 or 5, wherein all the annular beads have a circular circumference.

11. The drink can according to claim 1 or 5, wherein the annular beads of the closure cap and those of the lid lie diametrically opposite one another.

12. The drink can according to claims 1 or 5, wherein the sealing rings are provided with sealing elements.

13. The drink can according to claims 1 or 5, wherein the bulge within the first bead ring of the closure cap is constructed as a spherically domed area.

14. The drink can according to claims 1 or 5, wherein the opening in the lid and the opening in the closure cap are essentially coincident.

15. The drink can according to claim 1 or 5, wherein the closure cap is constructed like a plate with a marginal bead that widens conically outwards, the outer free flank of the marginal bead being used for fastening to the flanged rim of the drink can.

16. The drink can according to claim 15, wherein the bottom of the closure cap is bent slightly in the direction of the lid of the drink can.

17. The drink can according to claims 1 or 5, wherein the closure cap and the lid consist of the same material.

18. The drink can according to claim 17, wherein the material is metal.

19. The drink can according to claim 1 or 5, wherein a resiliently constructed region which accommodates the at least one off-center annular bead is partly bounded by slits in the closure cap, these slits extending at a distance from the at least one off center annular bead, starting from the inner conical flank of the fixed marginal bead of the closure cap and extending over part of the closure cap dimension.

20. The drink can according to claim 19, wherein each at least one off-center annular bead is assigned two slits, which are located in mirror-image fashion on opposite sides of the respective at least one off-center annular bead.

21. The drink can according to claim 19, wherein grooves are provided instead of the slits.

22. The drink can according to claim 19, wherein the slits or the grooves extend essentially parallel to a tangent to the at least one off-center annular bead.

* * * * *